US009169714B2

(12) United States Patent
Edwards et al.

(10) Patent No.: US 9,169,714 B2
(45) Date of Patent: Oct. 27, 2015

(54) FLUSHING SYSTEM

(75) Inventors: Jeffrey Charles Edwards, Aberdeenshire (GB); Michael Graham Morgan, Aberdeenshire (GB)

(73) Assignee: ENOVATE SYSTEMS LIMITED, Aberdeen, Aberdeenshire (GB)

( * ) Notice: Subject to any disclaimer, the term of this patent is extended or adjusted under 35 U.S.C. 154(b) by 680 days.

(21) Appl. No.: 13/498,963

(22) PCT Filed: Sep. 30, 2010

(86) PCT No.: PCT/GB2010/001843

§ 371 (c)(1),
(2), (4) Date: Jun. 1, 2012

(87) PCT Pub. No.: WO2011/039514

PCT Pub. Date: Apr. 7, 2011

(65) Prior Publication Data

US 2012/0241161 A1 Sep. 27, 2012

(30) Foreign Application Priority Data

Oct. 1, 2009 (GB) ..... 0917214.9
Jan. 29, 2010 (GB) ..... 1001452.0

(51) Int. Cl.
*E21B 33/076* (2006.01)
*E21B 41/00* (2006.01)

(52) U.S. Cl.
CPC ..... *E21B 33/076* (2013.01); *E21B 41/0007* (2013.01)

(58) Field of Classification Search
CPC ..... E21B 33/076; E21B 41/0007
USPC ..... 166/344, 360, 368, 311; 137/15.04, 137/15.05
See application file for complete search history.

(56) References Cited

U.S. PATENT DOCUMENTS 2,555,145 A * 5/1951 McKinney ..... 254/29 R
2,670,225 A * 2/1954 McKinney ..... 277/324
3,145,995 A * 8/1964 Adamson et al. ..... 166/53
3,500,307 A 3/1970 Gentry
3,500,907 A * 3/1970 Gentry ..... 166/70

(Continued)

FOREIGN PATENT DOCUMENTS

WO 2009082234 7/2009
WO WO 2009082234 A1 * 7/2009 ..... E21B 33/076

(Continued)

OTHER PUBLICATIONS

AU Patent Examination Report dated Nov. 14, 2014 for Pat. Appl. No. AU2010302483. 6 pages.

*Primary Examiner* — Matthew Buck
(74) *Attorney, Agent, or Firm* — Tarolli, Sundheim, Covell & Tummino LLP

(57) ABSTRACT

An apparatus for circulating well fluids in an intervention system is described. The apparatus comprises at least one subsea storage vessel adapted to be located adjacent a subsea intervention system, a first conduit adapted to provide fluid communication between the at least one storage vessel and the intervention system, a second conduit adapted to provide fluid communication between the at least one storage vessel and the intervention system and at least one pump adapted to pump fluid from the at least one storage vessel to the intervention system or from the intervention system to the at least one storage vessel through said first and/or second conduits.

25 Claims, 8 Drawing Sheets

(56) References Cited

U.S. PATENT DOCUMENTS

| | | | | |
|---|---|---|---|---|
| 3,637,009 | A * | 1/1972 | James | 166/351 |
| 5,048,603 | A * | 9/1991 | Bell et al. | 166/70 |
| 6,076,603 | A * | 6/2000 | Perrin | 166/304 |
| 6,192,680 | B1 | 2/2001 | Brugman et al. | |
| 7,331,393 | B1 * | 2/2008 | Hoel | 166/336 |
| 8,684,089 | B2 * | 4/2014 | Borhaug et al. | 166/344 |
| 8,978,767 | B2 * | 3/2015 | Machin et al. | 166/338 |
| 2010/0032163 | A1 * | 2/2010 | Richards et al. | 166/344 |
| 2011/0094749 | A1 * | 4/2011 | Richards et al. | 166/345 |
| 2011/0192610 | A1 * | 8/2011 | Machin et al. | 166/344 |

FOREIGN PATENT DOCUMENTS

| | | | |
|---|---|---|---|
| WO | 2010020956 | 2/2010 | |
| WO | WO 2010020956 A2 * | 2/2010 | F04D 13/10 |

* cited by examiner

FLUSHING SYSTEM

FIELD OF THE INVENTION

The present invention relates to an apparatus for circulating fluids in a well intervention system and to a method of circulating well fluids in an intervention system.

BACKGROUND TO THE INVENTION

Current operational trends are towards minimising the size and quantity of fluid conduits necessary to operate a subsea well, particularly as operations in deeper water are becoming more commonplace. One of the emerging intervention techniques involves the introduction of tooling into the well via a subsea intervention system. The intervention system comprises a safety package or lower riser package secured to the Christmas tree, a lubricator extending upwards from the lower riser package and a pressure control head, which is mountable to an open end of the lubricator. In this system there is no riser to surface, the intervention tooling being deployed through open water, transported with the pressure control head down to the lubricator. The pressure control head is landed on a latch at the open end of the lubricator, which seals and secures the pressure control head in position.

The intervention system must be able to manage three potentially conflicting operational requirements. The first is it must be robust enough to prevent the escape of high-pressure hydrocarbon well fluids in order to prevent potential damage to personnel, equipment and the environment. The second requirement is the system needs to be open mouthed in order to allow entry of wireline tooling and the pressure control head. The third requirement is that in order to avoid the creation of hydrates, which may occur under certain pressure and temperature conditions, the system must prevent mixing of gaseous high-pressure hydrocarbon well fluids with seawater, which occurs during every entry and departure of wireline tooling. To prevent the hydrate formation, seawater or hydrocarbons are displaced from the lubricator as necessary.

The displacement of seawater is generally achieved by pumping a flushing agent, such as monoethylene glycol (MEG), from a surface vessel down to the lower riser package and lubricator. MEG is a suitable flushing agent because it does not form hydrates when mixed with hydrocarbon gases and is also denser than seawater. When the MEG is pumped into the lower riser package and lubricator the MEG sinks to the bottom of the lower riser package and push the sea water upwards, out of the lubricator.

When downhole intervention operations take place, the intervention system becomes an extension of the well and the intervention system fills with hydrocarbon gas and/or oil. At the end of intervention operations, prior to opening the intervention system and recovery of the intervention tooling, the hydrocarbon must be removed from the intervention system. Conventional systems deal with this task by flushing the intervention system to, for example, (i) vent the hydrocarbons out into the sea (with the associated risk of forming hydrates and causing pollution), (ii) recover the hydrocarbons to surface for storage or (iii) force the fluids back into the well.

The nature of the intervention operations and the number of trips in and out of the well with tooling may require a number of exchanges between well fluids and MEG.

Whilst this system works reasonably successfully for shallow wells, in deep-sea environments the system encounters drawbacks. For example to pump the MEG from a surface vessel requires a longer, heavier hose, which adds to the cost of producing from deep sea wells and the vessels themselves require special equipment for handling the MEG and, in some cases, for controlling the heavier hose. Furthermore, if the hydrocarbon gas is recovered to surface, the vessel to which the hydrocarbon is recovered requires specialist equipment and personnel for dealing with this material. Alternatively, if the hydrocarbons are released into the sea, significant environmental damage can occur.

SUMMARY OF THE INVENTION

According to a first aspect of the present invention there is provided an apparatus for circulating well fluids in an intervention system, the apparatus comprising:

at least one subsea storage vessel adapted to be located adjacent a subsea intervention system;

a first conduit adapted to provide fluid communication between the at least one storage vessel and the intervention system;

a second conduit adapted to provide fluid communication between the at least one storage vessel and the intervention system; and at least one pump adapted to pump fluid from the at least one storage vessel to the intervention system or from the intervention system to the at least one storage vessel through said first and/or second conduits.

In one embodiment of the present invention, the apparatus described allows for hydrocarbon fluids to be flushed or removed from the intervention system with minimal impact on the environment, with minimal formation of hydrates and without requiring the hydrocarbon fluids to be recovered to a surface vessel. The provision of at least one storage vessel adjacent the intervention system allows for the hydrocarbon fluids within the intervention system to be flushed into the subsea storage vessels, allowing the intervention system to be opened and safely exposed to the environment, permitting, for example, a tool for performing an operation downhole to be introduced.

The at least one subsea storage vessel may be adapted to the supported by a subsea intervention system. The subsea intervention system can be utilised as a support for the storage vessels.

The at least one subsea storage vessel may be adapted to be attached to a subsea intervention system.

The at least one subsea storage vessel may be adapted to be releasably attached to a subsea intervention system.

The at least one storage vessel may be adapted to be attached to the subsea intervention system surface. The subsea intervention system surface provides a convenient and useful place to mount the storage vessels.

The at least one subsea storage vessel may be adapted to be releasably attachable to attachment points defined by the subsea intervention system.

The at least one subsea storage vessel may be adapted to be bolted, snap fitted, hooked or otherwise attached to the attachment points.

Alternatively or additionally, the at least one subsea storage vessel may be adapted to be releasably attached by means of straps or the like.

The at least one storage vessel may be, in use, axially aligned with the intervention system.

There may be a plurality of subsea storage vessels.

Where there are a plurality of subsea storage vessels, the storage vessels may be mounted around the circumference of the subsea intervention system.

In some embodiments, the subsea storage vessels may be adapted to enclose a portion of the subsea intervention system.

The subsea storage vessels may be linked in series.

The subsea storage vessels may be linked in parallel.

The pump may be operated by a remotely operated vehicle.

The pump may be hydraulically powered.

Hydraulic pressure may be applied to the pump by a remotely operated vehicle.

Alternatively, hydraulic pressure may be applied to the pump from surface.

In alternative embodiments, the pump may be electrically powered or powered by compressed air or the like.

The pump may be associated with one of the first or second conduits.

Conduits may be arranged such that as fluid flows from the at least one subsea storage vessel, in use, to the intervention system along one of the conduits, fluid flows from the intervention system to the at least one storage vessel along the other of said conduits.

Where the pump is associated with one of the first or second conduits, the pump may be adapted, in use, to pump into the intervention system or pump from intervention system.

In use, each of the first and second conduits is connected to the intervention system by a port.

In use, the subsea storage vessels may be located between the first and second conduit ports.

In use, the subsea storage vessels may be located on a surface of an intervention system between the first and second conduit ports.

One of the first or second conduits may comprise a vent to promote pressure to be released, in use, from the intervention system.

The/each at least one storage vessel comprises first and second valves adapted to seal the storage vessel. The valves provide a barrier between the storage vessel and the first and second conduits respectively.

According to a second aspect of the present invention there is provided a method of controlling well fluids, the method comprising the steps of:

pumping a volume of a flushing fluid from an at least one subsea storage vessel, located adjacent a subsea intervention system, into a portion of the intervention system; and flushing a volume of hydrocarbon fluid, under the action of the volume of flushing fluid, from the portion of the subsea intervention system into the at least one subsea storage vessel.

In one embodiment of the present invention, the method described allows for hydrocarbon fluids to be flushed or removed from the intervention system with minimal impact on the environment, with minimal formation of hydrates and without requiring the hydrocarbons to be recovered to surface. The provision of storage vessels adjacent the intervention system allows for the hydrocarbon gas within the intervention system to be flushed into the storage vessels, allowing the intervention system to be opened and safely exposed to the environment, permitting, for example, a tool for performing an operation downhole to be introduced.

In one embodiment hydrocarbon gas is only flushed from an upper portion of the intervention system. Having only an upper portion of the intervention system flushed to remove hydrocarbon gases minimises the scale of the exchange required to achieve the desired result of allowing the intervention system to be opened with minimal release of hydrocarbons into the environment.

Where the intervention system comprises an upper portion which is to be flushed of hydrocarbon gas, the upper portion is sealable from a lower intervention system portion by at least one sealing device.

The/each sealing device may be a ball valve or any suitable valve.

The method may further include the step of operating a subsea pump to pump the flushing fluid from the at least one subsea storage vessel to the intervention system portion.

The method may further include the step of operating a subsea pump to pump the flushing fluid from the at least one subsea storage vessel to the intervention system portion.

Alternatively or additionally, the method may further include the step of operating a subsea pump to pump or suck the flushing fluid from the at least one subsea storage vessel to the intervention system portion.

Where a volume of flushing fluid is removed from the at least one subsea storage vessel, the volume may be replaced with a replacement fluid. Using a replacement fluid prevents a vacuum being drawn in the storage vessel.

The replacement fluid may be relatively inert gas.

The replacement fluid may be nitrogen. Nitrogen is used because it is lighter than conventional flushing fluids.

The replacement fluid in an alternative may be carbon dioxide.

The flushing fluid may be monoethylene glycol.

The method may further comprise the step of removing a pressure control head from the intervention system to expose the portion of the intervention system to the environment.

The method may further comprise the step of disconnecting a pressure control head from the intervention system. A pressure control head is used to contain pressure which may build up within the intervention system when the intervention system or wellhead valves are opened and the intervention system is exposed to well pressure.

The method may further comprise the step of recovering the pressure control head to surface. The pressure control head maybe removed from the intervention system to allow a downhole tool, for example to be recovered to surface. In one embodiment, once the pressure control head is recovered to surface, tools can be exchanged in preparation of performing another downhole operation.

The method may further comprise the step of attaching a pressure control head to the intervention system.

The step of attaching the pressure control head to the intervention system may further comprise locking and/or sealing the pressure control head to the intervention system.

The method may further comprise a step of equalising pressure in the intervention system with the ambient pressure external to the intervention system.

In one embodiment only an upper portion of the intervention system is equalised with the ambient pressure.

The method may further comprise a step of equalising pressure in the intervention system with the well pressure.

Alternatively or additionally, the method may further comprise a step of pressurising the intervention system portion to well pressure. Once the intervention system is at well pressure, the lubricator valves can be opened, exposing the intervention system portion to the well and allowing a tool to be run into the well to perform a downhole operation.

The method may further comprise the step of pumping or sucking the first volume of flushing fluid from the intervention system portion into the at least one subsea storage vessel.

In this embodiment the method may further include the step of replacing the first volume of flushing fluid removed from the intervention system with the volume of hydrocarbon fluid.

The action of pumping or sucking the first volume flushing fluid out of the intervention system portion and back into the storage vessels may force the hydrocarbon fluid in the storage vessel back into the intervention system.

The method may comprise the step of opening an intervention system or wellhead valve exposing the intervention system to well pressure.

The method may comprise the initial step of running the intervention system down to the subsea well head.

In this embodiment the method may further comprise the step of attaching the subsea intervention system to the wellhead.

The method may further comprise the step of displacing a volume of water from the intervention system by pumping a quantity of flushing fluid from the at least one storage vessel into the intervention system, the flushing fluid being denser than the sea water, the sea water being displaced into the sea.

The intervention system may comprise a lower riser package and a lubricator.

The lower riser package may be attached to the wellhead.

The lubricator may be attached to the lower riser package.

The upper intervention system portion may be defined by the lubricator.

The intervention system may comprise a first port and a second port, the first and second ports being in communication with the at least one subsea storage vessel.

The first intervention system port may be in communication with one end of the at least one subsea storage vessel and the second intervention system port may be in communication with the second end of the at least one subsea storage vessel.

Where the intervention system comprises a lubricator and a lower riser package, the first and second ports may be defined by the lubricator.

According to a third aspect of the present invention there is provided a system for circulating well fluids, the apparatus comprising:

an intervention system adapted to be connected to a well head;

at least one subsea storage vessel located adjacent the subsea intervention system;

a first conduit providing fluid communication between the at least one storage vessel and the intervention system;

a second conduit providing fluid communication between the at least one storage vessel and the intervention system; and at least one pump adapted to pump fluid from the at least one storage vessel to the intervention system or from the intervention system to the at least one storage vessel through said first and/or second conduits.

According to a fourth aspect of the present invention there is provided a method of running a tool into an intervention system containing hydrocarbon gas, the method comprising the steps of:

flushing a volume of hydrocarbon gas from at least a portion of the intervention system by pumping a first volume of flushing fluid from an at least one subsea storage vessel, located adjacent the intervention system, into the portion of the intervention system, the first volume of flushing fluid being denser than the hydrocarbon gas, the hydrocarbon gas being displaced into the at least one subsea storage vessel;

recovering a production control head to surface;

running the production control head and a tool down to the intervention system; and attaching the production control head to the intervention system.

The method may further comprise the step of pumping or sucking the first volume of flushing fluid from the intervention system portion back into the at least one storage vessel, the hydrocarbon gas from the at least one storage vessel being displaced into the intervention system portion.

The method may alternatively comprise the step of opening an intervention system and/or wellhead valve to expose the intervention system to the well such that the first volume of flushing fluid is displaced downhole by a further volume of hydrocarbon gas.

It will be understood the features associated with one aspect may be equally applicable to any other aspect and have not been repeated for brevity.

BRIEF DESCRIPTION OF THE DRAWINGS

An embodiment of the present invention will now be described with reference to the accompanying Figures in which.

DETAILED DESCRIPTION OF THE DRAWINGS

Figure 1:
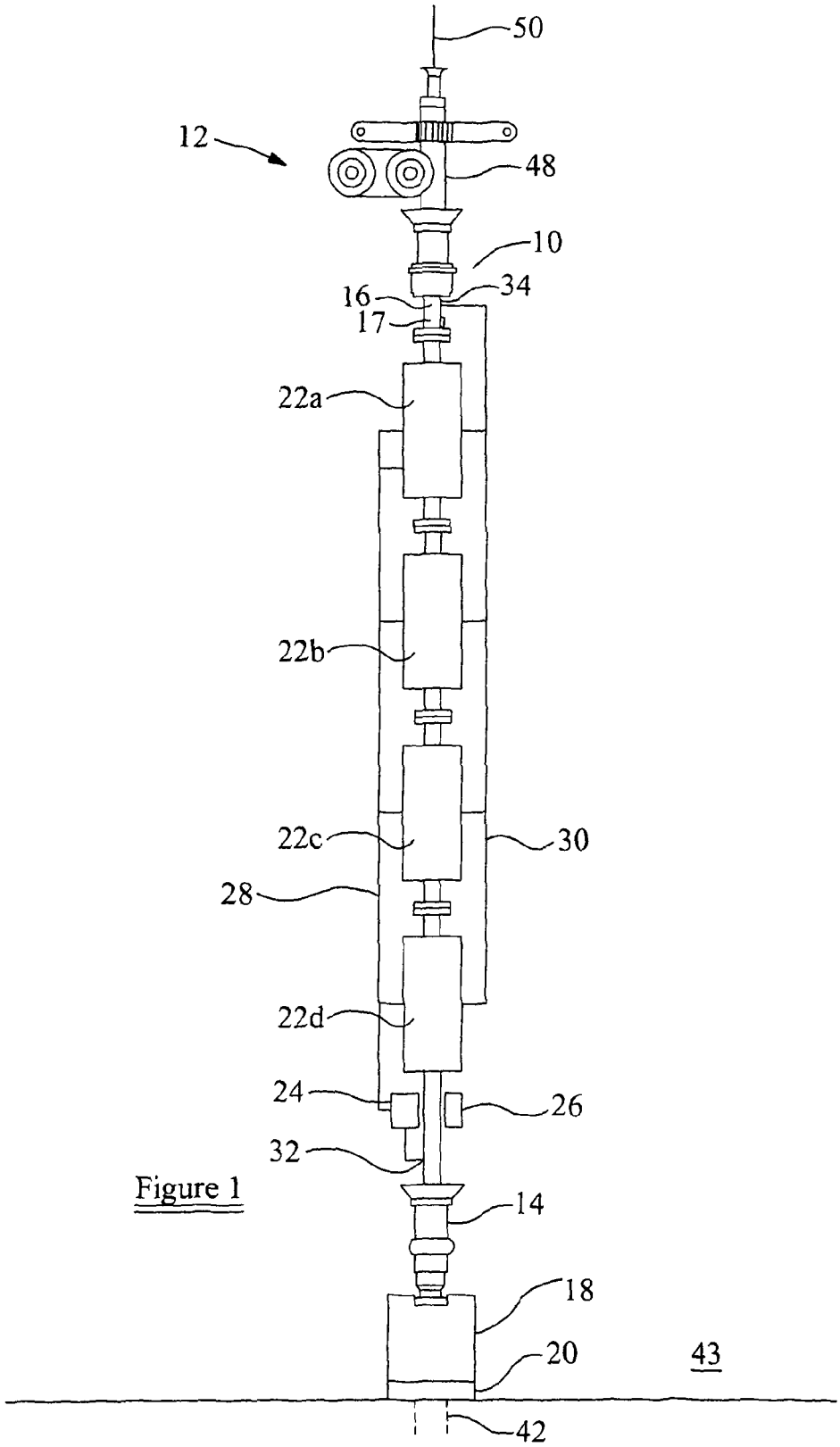
FIG. 1 is a front schematic view of a fluid circulation apparatus for circulating well fluids in an intervention system, shown mounted to an intervention system, according to a first embodiment of the present invention.

Referring firstly to FIG. 1, a front view of a fluid circulation apparatus, generally indicated by reference 10, shown mounted to an intervention system 12, according to a first embodiment of the present invention. The intervention system 12 comprises a lower riser package 14 and a lubricator 16. The lower riser package 14 is secured to a tree 18 which is mounted to a well head 20. The well head 20 is the interface between a well 42 (shown in broken outline) and the surrounding environment.

The fluid circulation apparatus 10 includes four storage vessels 22*a-d*, a pump 24, a hydraulic motor 26, a first conduit or fluid line 28 and a second conduit or fluid line 30.

The first fluid line 28 provides fluid communication, via the pump 24, between the storage vessels 22 and a lower end of intervention system lubricator 16 connecting to the lubricator 16 through a port 32. The second fluid line 30 provides fluid communication between the storage vessels 22 and an upper end of the intervention system lubricator 16, the second fluid line 30 connecting to the lubricator 16 through a port 34.

Each of the storage vessels 22, is attached to the surface 17 of the intervention lubricator 16. Although not shown for clarity, each of the storage vessels 22*a-d* comprises six cylinders strapped together to form the storage vessel 22*a-d*. Arranging the storage vessels 22 in this way, in a subsea location, allows for hydrocarbons to be flushed from the intervention system 12, for the purposes of opening the intervention system 12 to the environment, without recovering the hydrocarbons to surface, thereby eliminating the need for the surface vessel to be equipped to handle hydrocarbons.

The apparatus 10 and its operation will now be described in more detail with reference to FIGS. 2 to 8, a series of schematic views of the apparatus 10 for circulating well fluids and the intervention system 12 of FIG. 1 at different stages of operation of the circulating apparatus 10.

Figure 2:
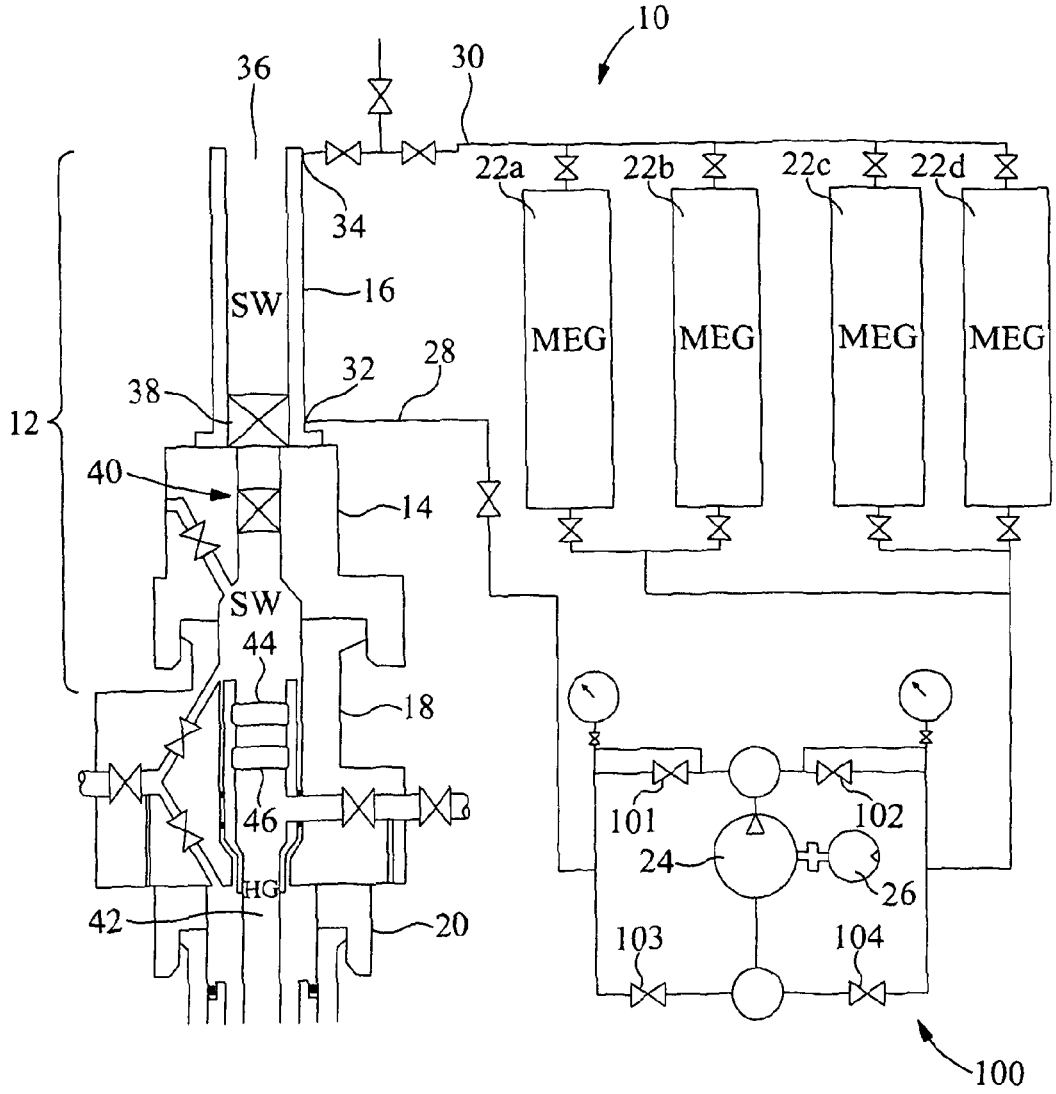
FIGS. 2 to 8 illustrate a series of schematic views of the apparatus for circulating well fluids and the intervention system of FIG. 1 at different stages of operation of the circulating apparatus.

Referring to FIG. 2, the four storage vessels 22 are shown connected in parallel. This arrangement permits well fluids to be circulated into or out of a chosen vessel 22 easily. Fluids are circulated between the vessels 22 and the intervention system 12 by the hydraulic pump 24. The pump 24 is driven by the hydraulic motor 26, the motor 26 being adapted to be driven by a remotely operated vehicle (not shown). The pump 24 includes a pump circuit 100 comprising first, second, third and fourth pump valves 101-104 which can be utilised to draw fluid from the storage vessels 22 for pumping into the lubricator 16 or draw fluid from the lubricator 16 for pumping into the storage vessels 22.

The lubricator 16 defines an open-end 36 adapted to receive a production control head (not shown but discussed later). At a lower end of the lubricator 16 is a lubricator valve 38 for sealing the lubricator from the lower riser package 14 and, ultimately, the well 42. The lower riser package 14 also includes a safety valve, the lower riser package valve 40.

Prior to the commencement of intervention operations, the wellhead 20 is sealed by first and second plugs 44, 46. Both the lubricator 16 and the lower riser package 14 are filled with sea water, indicated by "SW" on FIG. 2, at ambient pressure. Beneath the first and second plugs 44, 46 the well bore 42 is filled with hydrocarbon fluids and particularly, at the upper end of the well bore 42 immediately adjacent the plugs 44, 46, hydrocarbon gas "HG" at well pressure. The storage vessels 22 are filled with a flushing fluid, monoethylene glycol "MEG".

Figure 3:
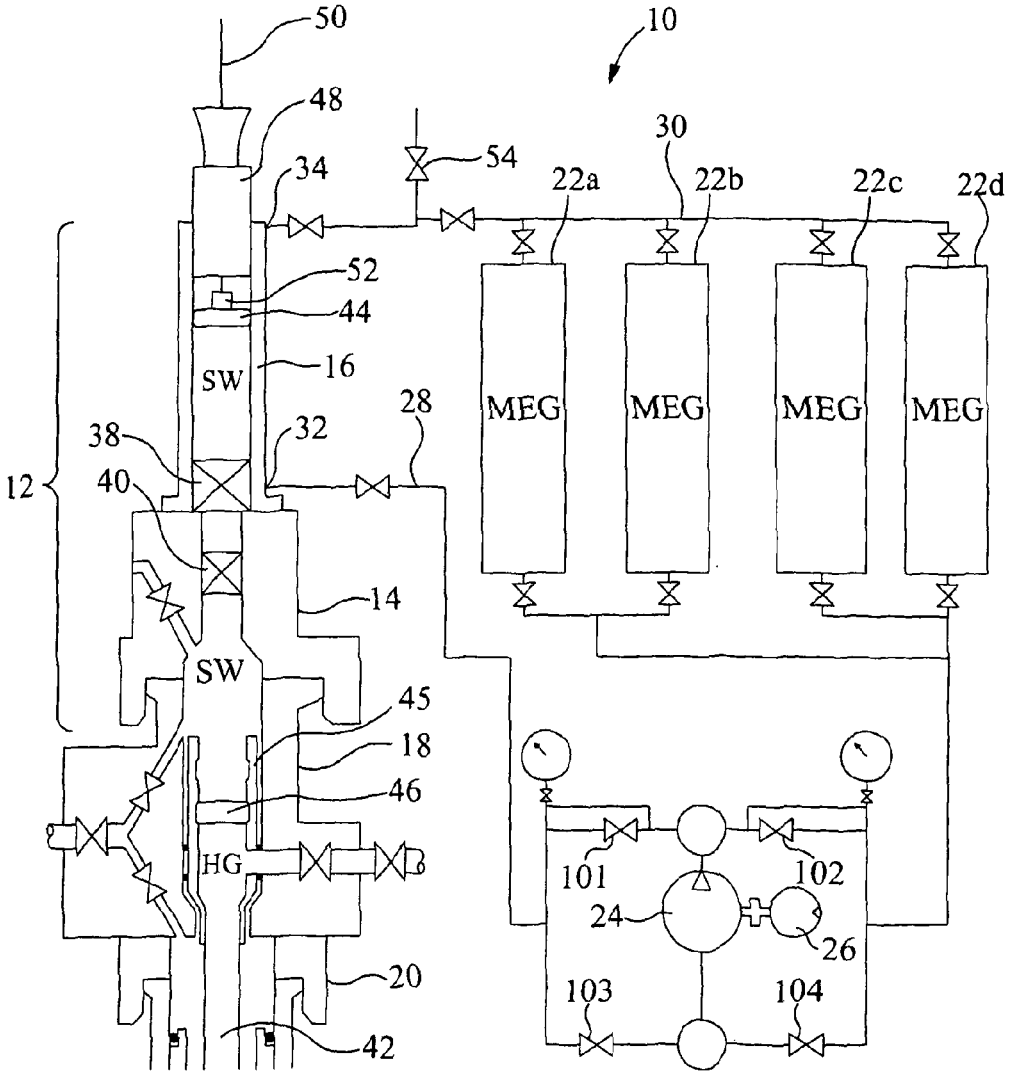

The operation of the subsea fluid circulation apparatus 10 will now be described. The first operation to be performed before an intervention can take place in the well 42 is to remove the first and second plugs 44, 46. Referring to FIG. 3, a production control head 48 is run down to the intervention system 12 from a surface vessel on a wireline cable 50. The production control head 48 is secured and sealed to the lubricator open end 36. The pressure control head 48 is designed to seal the intervention system 12 so the upstream barriers 38,40,44,46 can be removed or opened and the intervention system 12 can be exposed to well pressure without the danger of leakage through the lubricator end 36.

Attached to the end of the wireline cable 50 is a plug pulling tool 52. The lubricator valve 38 and the lower riser package valve 40 are opened, and the plug pulling tool 52 is lowered through the valves 38, 40 into engagement with the first plug 44. A pull force is applied to the wireline cable 50 from surface and the first plug 44 is pulled from the tree 18, and particularly from the plug recess 45 defined by the tree 18.

As can be seen from FIG. 3, once the first plug 44 has been pulled, the second plug 46 is the primary barrier between the intervention system 12 and the well 42. The first plug 44 is recovered into the lubricator 16 and the lubricator and lower riser package valves 38,40 are sealed, providing additional well containment barriers.

The next stage is to recover the first plug 44 to surface and send the tool 52 back to the intervention system 12 to remove the second plug 46. However, the diameter of the first plug 44 is too wide to permit the plug 44 to be pulled through the control head 48, therefore the production control head 48, the pulling tool 52 and the first plug 44 must be recovered to surface together. When the production control head 48 and the plug 44 reach the surface, the plug 44 is removed from the plug pulling tool 52. Both the tool 52 and the production control head 48 are then returned to the intervention system 12 to recover the second plug 46. On arrival at the intervention system 12, the production control head 48 is secured and sealed to the lubricator 16 once again.

Before the second plug 46 can be pulled, the sea water SW in the intervention system 12 must be flushed out because once the second plug 46 is pulled, hydrocarbon gas HG will flood the intervention system 12 and, if the hydrocarbon gas HG comes into contact with sea water SW, hydrates may be formed which can cause blockages.

Figure 4:
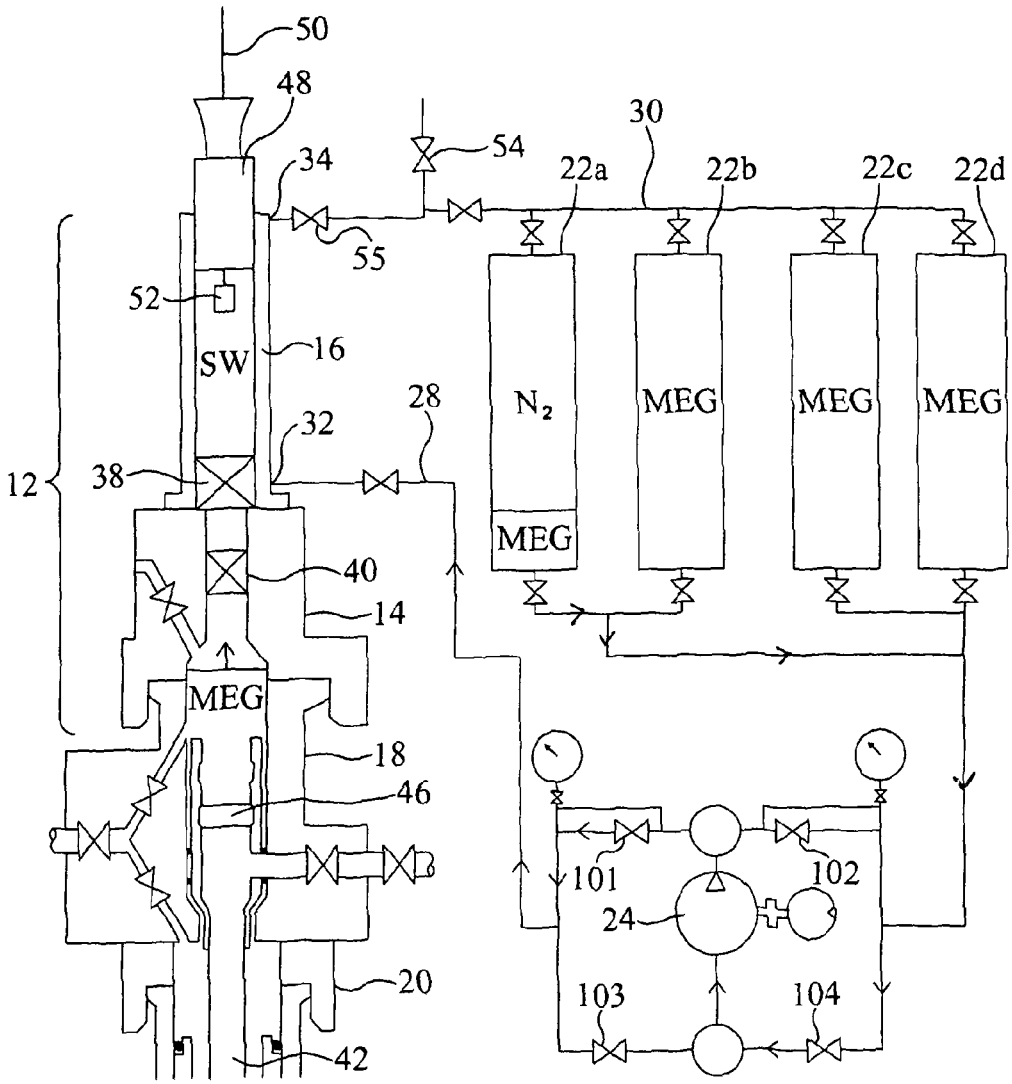

FIG. 4 shows the arrangement of the apparatus 10 and intervention system 12 when the production control head 48 has been secured and sealed to the lubricator 16 prior to the removal of the second plug 46. To flush the seawater SW out, the MEG in the first storage tank 22*a* is pumped by the pump 24 via the first fluid line 28 and the first and fourth pump valves 101,104, into the intervention system 12 through a first port 32. To prevent the pump 24 drawing a vacuum, a volume of pre-charged nitrogen within the first storage tank 22*a* expands to fill the space left by the MEG removed from the storage tank 22*a*. In the intervention system 12, as MEG is heavier than sea water, the MEG sinks to the bottom of the intervention system 12, down as far as the second plug 46, displacing the sea water upwards. Continued introduction of MEG into the intervention system forces the sea water SW out of the lubricator 16 through a lubricator second port 34, a second port valve 55 and a vent valve 54 into the sea surrounding the intervention system 12. Once all the sea water has been driven out of the intervention system 12 the second port valve 55 and the vent valve 54 is closed. Further MEG is pumped into the intervention system 12 to raise the pressure within the intervention system 12 to well pressure.

Figure 5:
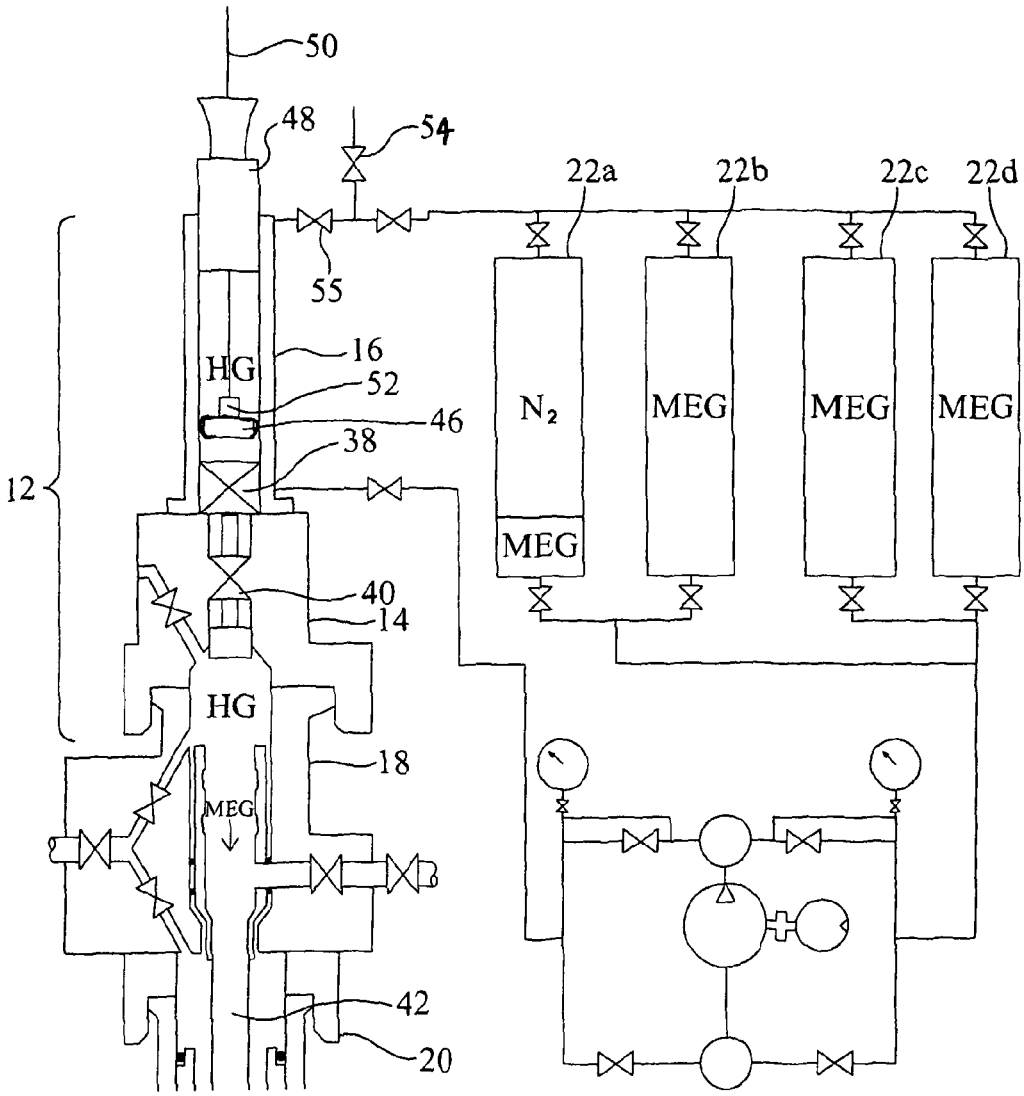

Referring to FIG. 5, the lower plug 46 has been pulled and hydrocarbon gas HG fills the intervention system 12. As the MEG in the lubricator 16 and the lower riser package 14 is denser than the hydrocarbon gas HG, the MEG sinks down the well 42 where it is lost. The plug 46 is recovered into the lubricator 16 via the pulling tool 52 and the lower riser package and lubricator valves 40, 38 are closed to seal the lubricator 16 from the well 42 and to contain the well 42.

To permit intervention operations to be performed in the well 42, the second plug 46 is recovered to surface with the production control head 48. However, prior to retrieval of the production control head 48 and the plug 46, the hydrocarbon gas HG must be removed from the lubricator 16, to prevent the contents of the lubricator 16 escaping in to the environment when the production control head 48 is disconnected from the lubricator 16. Once opened, any hydrocarbon gas remaining in the lubricator 16 would be emitted into the sea 43 surrounding the fluid circulation apparatus 10.

Only the quantity of hydrocarbon gas HG in the lubricator 16 needs to be removed because the lower riser package valve 40 and the lubricator valve 38 are both sealed, the valves 38, 40 acting as a barrier, preventing the hydrocarbons in the lower riser package 14 and the well 42 from escaping.

Figure 6:
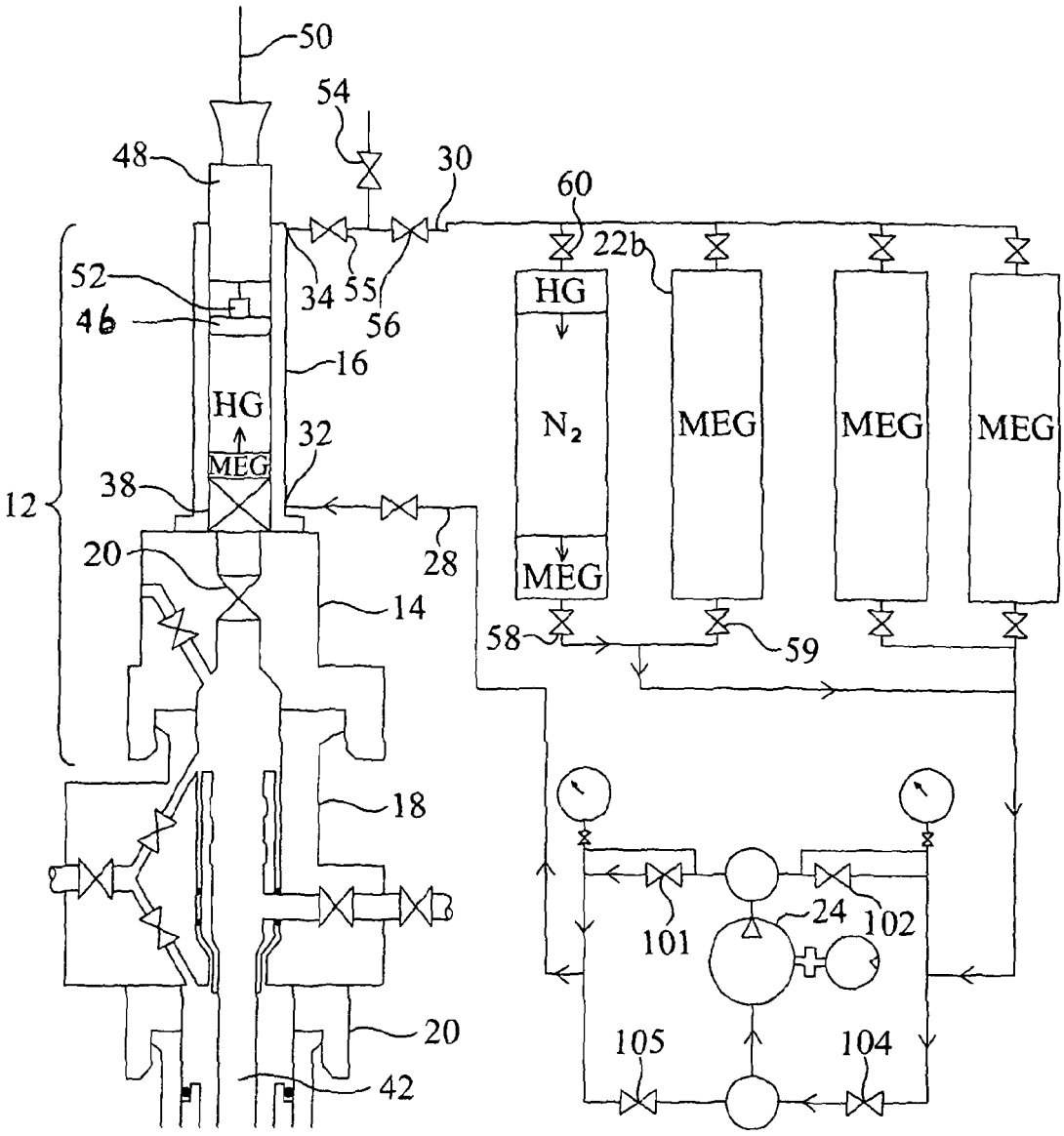

Referring to FIG. 6, the hydrocarbon gas HG in the lubricator 16 is flushed from the lubricator 16 and into the first storage vessel 22*a*, as follows. The vent valve 54 is closed and the second port valve 55 and a second fluid line valve 56 are opened. The remaining MEG in the first storage vessel 22*a* is pumped into the bottom of the lubricator 16 via the pump 24, the first fluid line 28 and the first port 32. As the MEG is heavier than the hydrocarbon gas HG, the hydrocarbon gas HG is pushed upwards and out the second port 34. The hydrocarbon gas HG is transferred into the first storage vessel 22*a* via the second port valve 55, the second fluid line 30 and the second fluid line valve 56. Once the first vessel 22*a* is emptied of MEG, the first vessel lower valve 58 is shut and a second vessel lower valve 59 is opened, permitting MEG to be drained from the second vessel 22*b*. Again as the vessel 22*b* is emptied of MEG, a pre-charged volume of nitrogen expands to fill the space left by the removal of the MEG from the second vessel 22*b*, preventing the pump 24 drawing a vacuum.

Figure 7:
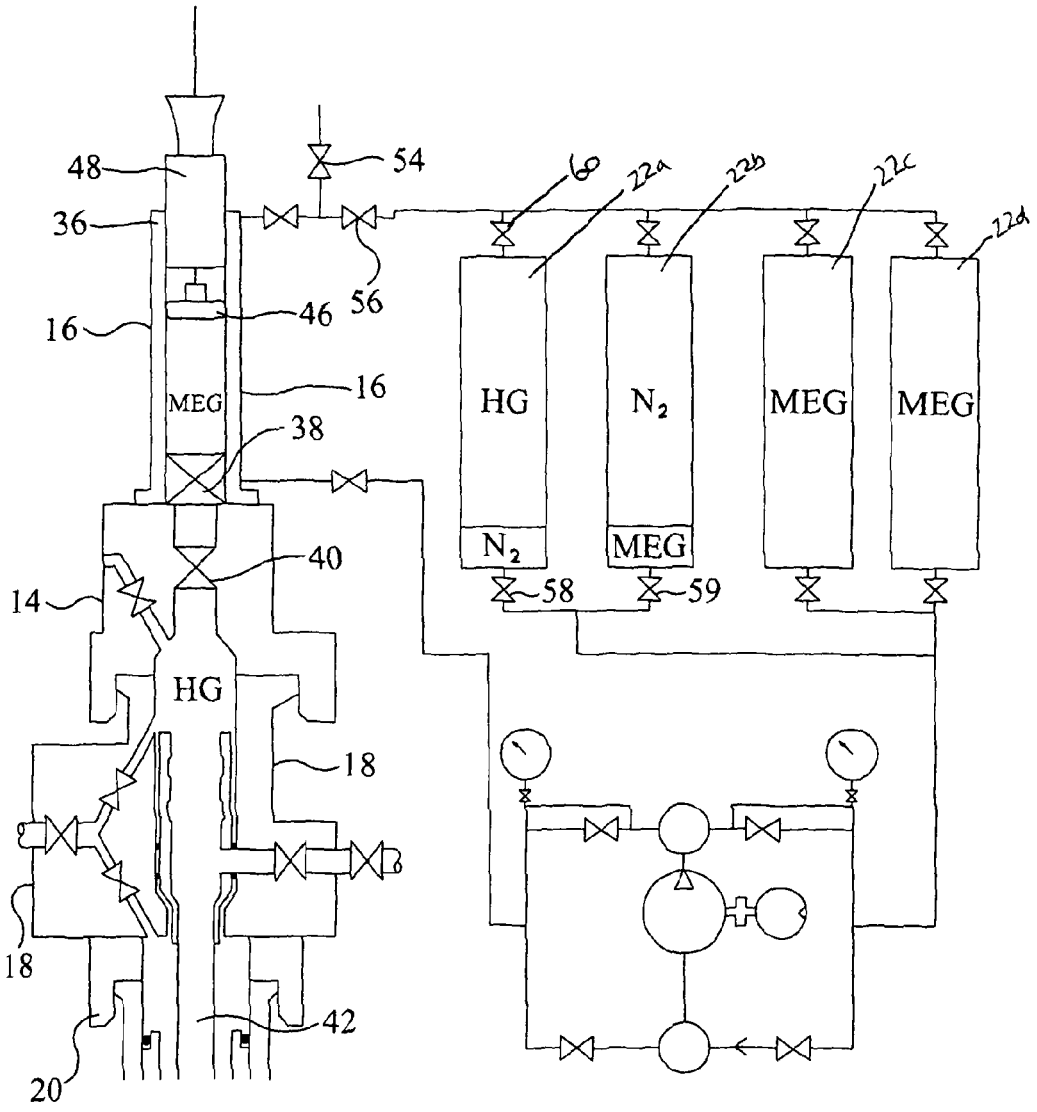

Referring to FIG. 7, once all the hydrocarbon gas HG been flushed from the lubricator 16, the first vessel upper valve 60 is shut, trapping the hydrocarbon gas HG and the volume of nitrogen within the first vessel 22*a*. The second fluid line valve 56 is shut and the vent valve 54 is opened to release the pressure in the lubricator 16 and equalise it with the ambient pressure of the surrounding sea water.

To summarise, at this point, as shown in FIG. 7, the hydrocarbon gas HG previously in the lubricator 16 is now in the first vessel 22*a* and the lubricator 16 is filled with MEG which has been vented to ambient pressure through the vent valve 54.

As the lubricator valve 38 and the lower riser package valve 40 are shut, it is now safe to open the lubricator 16 to recover the second plug 46 and the production control head 48 to surface without polluting the surrounding environment with hydrocarbon gas HG. As MEG is heavier than sea water, the MEG will remain within the lubricator 16 once the production control head 48 has been detached from the lubricator open end 36.

From the arrangement shown in FIG. 7, any number of operations can be performed downhole. The fluid circulation apparatus 10 allows for the hydrocarbon gas HG to replace the MEG in the lubricator 16, the MEG being circulated back into the storage vessels 22 to permit the lubricator valve 38 and the lower riser package valve 40 to be opened, allowing well intervention to take place.

Figure 8:
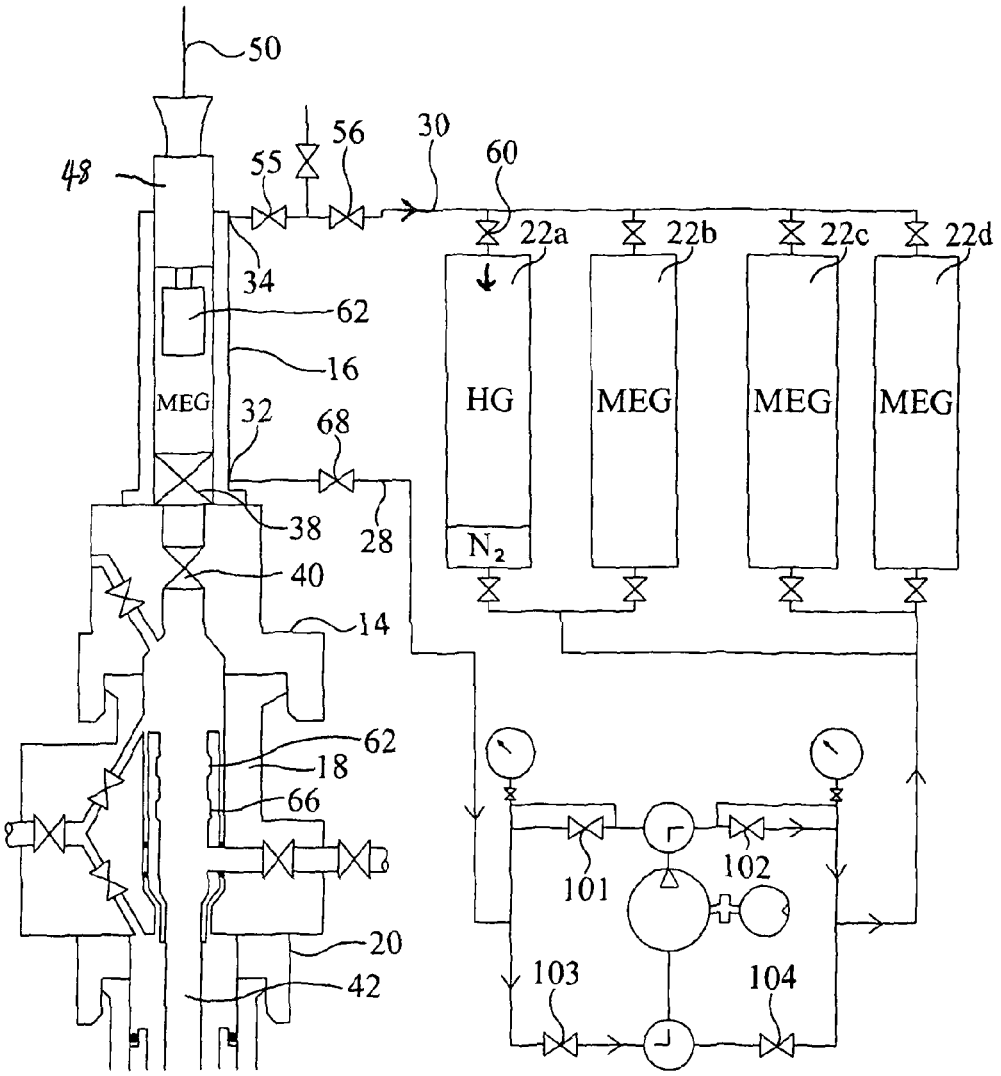

The process of replacing the MEG in the lubricator 16 with the hydrocarbon gas HG in the first vessel 22*a* will now be described with reference to FIG. 8. In FIG. 8, the production control head 48 has been run back down to the intervention system 12 and attached to the lubricator open end 36. Attached to the wireline cable 50 is a wear sleeve 62 for running down to the tree 18 to cover a first plug recess 64 and a second plug recess 66 into which the first and second plugs 44, 46 respectively sat prior to removal. The purpose of the wear sleeve 62 is to protect the recesses 64, 66 from damage, which may occur during intervention operations. Once intervention operations have finished, the plugs 44, 46 may be replaced in the recesses 64, 66 prior to production from the well 42. The wear sleeve 62 will ensure the recesses 64,66 are still intact.

Once the pressure control head 48 is sealed to the lubricator 16, the lubricator and lower riser package valves 38, 40 could be opened however; the MEG that was in the lubricator 16 would then be lost downhole. In the procedure shown in FIG. 8, the MEG in the lubricator 16 is recovered to the storage vessels 22*a*, 22*b* and the hydrocarbon gas HG stored in the storage vessel 22*a* is returned to the lubricator 16. This conserves MEG and consequently prolongs the time between re-filling of the apparatus 10 with MEG. To recover the MEG to the storage vessels 22, the first and fourth pump valves 101, 104 are shut and the second and third pump valves 102, 103 are opened. This switching of the valves changes the direction of flow of fluid, the pump 24 now pumping from the lubricator 16 to the storage vessels 22 through the first port 32. The pump 24 is operated and the MEG in the lubricator 16 is drawn out of first port 32 and along the first fluid line 28 and pumped, initially in to the second storage vessel 22*b* and then, once the second vessel 22*b* is full, into the first vessel 22*a*. During pumping of the MEG into the first storage vessel 22*a*, the first vessel upper valve 60, the second fluid line valve 56 and the second port valve 55 are open. As the MEG is pumped into the first storage vessel 22*a*, hydrocarbon gas HG is pumped out of the vessel 22*a* and back into the lubricator 16 via the second fluid line 30 and the second port 34.

This process continues until the lubricator 16 is filled with hydrocarbon gas HG. Once the MEG has been drained from the lubricator 16, the first fluid line valve 68 is shut and continued pumping by the pump 24 raises the pressure within the lubricator 16 until it is equalised with the pressure in the well 42. The second port valve 55 is shut and the lubricator valve 38 and the lower riser package valve 40 are opened, exposing the lubricator 16 to well pressure. The wear sleeve 62 is then run down to the recesses 64, 66 and deployed.

In this position, the tool (not shown) used to run the wear sleeve 62 into the well 42 can then be recovered into the lubricator 16 and once the lubricator valve 38 and the lower riser package valve 40 are sealed, the situation is the same as shown in FIG. 5 and the sequence of FIGS. 5, 6 and 7 can be repeated to bring other tools down to the well 42 and perform further intervention operations.

Various modifications and improvements may be made to the above-described embodiment without departing from the scope of the present invention. For example, Although nitrogen is used to prevent the system drawing a vacuum, an alternative inert gas such as carbon dioxide could be used.

The invention claimed is:

1. An apparatus for circulating well fluids in an intervention system, the apparatus comprising:

a plurality of subsea storage vessels adapted to be located adjacent a subsea intervention system, wherein the subsea storage vessels are linked in parallel;

a first conduit adapted to provide fluid communication between the storage vessels and a lower end of the intervention system;

a second conduit adapted to provide fluid communication between the storage vessels and an upper end of the intervention system; and at least one pump adapted to pump fluid from the storage vessels to the intervention system through said first conduit and from the intervention system to the storage vessels through said second conduit, and adapted to pump fluid from the storage vessels to the intervention system through said second conduit and from the intervention system to the storage vessels through said first conduit.

2. The apparatus of claim 1, wherein the subsea storage vessels are adapted to be supported by the subsea intervention system.

3. The apparatus of claim 2, wherein the subsea storage vessels are adapted to be attached to the subsea intervention system.

4. The apparatus of claim 3, wherein the subsea storage vessels are adapted to be releasably attached to the subsea intervention system.

5. The apparatus of claim 4, wherein the subsea storage vessels are adapted to be attached to the subsea intervention system surface.

6. The apparatus of claim 5, wherein the subsea storage vessels are adapted to be releasably attachable to attachment points defined by the subsea intervention system.

7. The apparatus of claim 6, wherein the subsea storage vessels are adapted to be bolted, snap fitted, hooked or otherwise attached to the attachment points.

8. The apparatus of claim 4, wherein the subsea storage vessels are adapted to be releasably attached by means of straps or the like.

9. The apparatus of claim 1, wherein the subsea storage vessels are, in use, axially aligned with the intervention system.

10. The apparatus of claim 1, wherein the storage vessels are mounted around the circumference of the subsea intervention system.

11. The apparatus of claim 10, wherein the subsea storage vessels are adapted to enclose a portion of the subsea intervention system.

12. The apparatus of claim 1, wherein the at least one pump is operated by a remotely operated vehicle.

13. The apparatus of claim 1, wherein the at least one pump is hydraulically powered.

14. The apparatus of claim 13, wherein hydraulic pressure is applied to the at least one pump by a remotely operated vehicle.

15. The apparatus of claim 13, wherein hydraulic pressure is applied to the at least one pump from surface.

16. The apparatus of claim 13, wherein the at least one pump is electrically powered or powered by compressed air or the like.

17. The apparatus of claim 1, wherein the at least one pump associated with one of the first or second conduits.

18. The apparatus of claim 17, wherein the first or second conduits are arranged such that as fluid flows from the subsea storage vessels, in use, to the intervention system along one of the conduits, fluid flows from the intervention system to the subsea storage vessels along the other of said conduits.

19. The apparatus of claim 17, wherein where the at least one pump is associated with one of the first or second conduits, the at least one pump is adapted, in use, to pump into the intervention system or pump from intervention system.

20. The apparatus of claim 1, wherein in use, each of the first and second conduits is connected to the intervention system by a port.

21. The apparatus of claim 20, wherein, in use, the subsea storage vessels are located between the first and second conduit ports.

22. The apparatus of claim 21, wherein in use, the subsea storage vessels are located on a surface of the intervention system between the first and second conduit ports.

23. The apparatus of claim 1, wherein one of the first or second conduits comprise a vent to promote pressure to be released, in use, from the intervention system.

24. The apparatus of claim 1, wherein each of the storage vessels comprises first and second valves adapted to seal the storage vessel.

25. A system for circulating well fluids, the system comprising:

an intervention system adapted to be connected to a well head;

a plurality of subsea storage vessels located adjacent the subsea intervention system, wherein the subsea storage vessels are linked in parallel;

a first conduit providing fluid communication between the storage vessels and a lower end of the intervention system;

a second conduit providing fluid communication between the storage vessels and an upper end of the intervention system; and at least one pump adapted to pump fluid from the storage vessels to the intervention system through said first conduit and from the intervention system to the storage vessels through said second conduit, and adapted to pump fluid from the storage vessels to the intervention system through said second conduit and from the intervention system to the storage vessels through said first conduit.

* * * * *